US005110717A

United States Patent [19]

Czekai et al.

[11] Patent Number: 5,110,717

[45] Date of Patent: May 5, 1992

[54] STABILITY IMPROVEMENT OF AMORPHOUS PARTICLE DISPERSIONS

[75] Inventors: David A. Czekai, Honeoye Falls; John F. Bishop, Rochester, both of N.Y.

[73] Assignee: Eastman Kodak Company, Rochester, N.Y.

[21] Appl. No.: 628,969

[22] Filed: Dec. 17, 1990

[51] Int. Cl.[5] ..... G03C 1/815; G03C 1/825

[52] U.S. Cl. ..... 430/512; 264/5; 428/402; 430/510; 430/931

[58] Field of Search ..... 427/384; 430/510, 512, 430/931; 264/5, 6; 428/402

[56] References Cited

U.S. PATENT DOCUMENTS

| | | | |
|---|---|---|---|
| 2,747,996 | 5/1956 | Edgerton et al. | 95/2 |
| 3,676,139 | 7/1972 | Amano et al. | 96/82 |
| 4,518,686 | 5/1983 | Sasaki et al. | 430/512 |
| 4,587,346 | 5/1986 | Winter et al. | 548/260 |
| 4,749,643 | 6/1988 | Ohlschlager et al. | 430/931 X |
| 4,865,957 | 9/1989 | Sakai et al. | 430/505 |
| 4,948,718 | 8/1990 | Factor et al. | 430/512 X |

FOREIGN PATENT DOCUMENTS 56-082830 7/1981 Japan .

*Primary Examiner*—Michael Lusignan
*Attorney, Agent, or Firm*—Paul A. Leipold

[57] ABSTRACT

An object of the invention is to overcome disadvantages of prior practices. A further object of the invention is to provide a process for providing particles that result in improved UV absorption in photographic products.

An additional object is to provide lower cost polymer particle dispersions.

The invention is generally accomplished by mechanically grinding a crystalline material to a desired particle size in a liquid that is not a solvent for the material, heating said crystalline particles dispersed in said liquid to above their melting temperature, and cooling the melted particles in said liquid to form amorphous particles. In preferred forms of the invention, the material is a photographically useful material, such as ultraviolet light absorber or coupler.

16 Claims, 5 Drawing Sheets

STABILITY IMPROVEMENT OF AMORPHOUS PARTICLE DISPERSIONS

TECHNICAL FIELD

This invention relates to the dispersion of fine amorphous particles in liquids. It particularly relates to the dispersion of crystalline particles in liquid followed by heating and cooling to form a more spherical amorphous particles.

BACKGROUND ART

The preparation of fine particle systems such as solid-in-liquid dispersions, oil-in-water emulsions, and water-in-oil emulsions can be carried out by a wide variety of processes, including grinding, homogenization, and precipitation. Emulsions are typically described as liquid-in-liquid or amorphous particle-in-liquid systems and are usually prepared by incorporating a liquid or resinous dispersed phase into a liquid continuous phase under high shear mixing or homogenization. Certain emulsions exhibit poor stability due to the surface energetics of the liquid dispersed Phase and may coalesce, crystallize, or degrade in time. Also, most conventional mixers or homogenizers are limited in the ability to reduce particle size below 300 nm.

In certain applications, such as with photographic dispersions, crystalline materials such as dye forming couplers, oxidized developer scavengers, and various dyes are dissolved in organic solvents at high temperatures and emulsified in aqueous gelatin solutions. Submicron amorphous particles in such dispersions are found to be metastable and will eventually recrystallize in this aqueous system unless coated and dried on photographic support, in which state they are stable against recrystallization. Recrystallization of the dispersed particles prior to coating reduces dispersion efficacy and is generally considered undesirable.

The composition of the dispersed amorphous phase is often modified by incorporation of mixtures of solvents and crystalline organic compounds to improve stability against recrystallization. Such additives are often undesirable and may adversely affect photographic response and physical quality of photographic materials.

U.S. Pat. No. 4,865,957, columns 19–21, illustrates the techniques of UV absorber particle formation by melting the UV absorber and incorporating it into a high boiling point organic solvent which is then homogenized and cooled. However, particles formed by such emulsification techniques have been particularly susceptible to recrystallization and crystal growth after cooling. Such crystallization is disadvantageous to product quality due to light scattering and filter plugging during manufacturing by the large grown crystals.

While the solid UV stabilizers have been successful, they are difficult to maintain in the amorphous phase which is preferred to prevent light scattering. Further, the solvent emulsification technique has been expensive and difficult to control. Crystallization of the UV absorber may also lead to delamination of layers, haze, reduced maximum density, stain, and sensimetric problems.

There is a need for a process to overcome prior problems of incorporation of UV absorbers that are solid at room temperatures and in the amorphous phase. Another disadvantage of the present process to be overcome is that the particles of UV absorbers are generally larger than is desirable, thereby resulting in a lesser amount of the absorption, as well as causing more light scattering. It would be desirable if UV absorbers could be made in finer particles with less tendency for crystallization.

DISCLOSURE OF INVENTION

An object of the invention is to overcome disadvantages of prior practices.

A further object of the invention is to provide a process for providing particles that result in improved UV absorption in photographic products.

An additional object is to provide lower cost particle dispersions.

These and other objects of the invention are generally accomplished by mechanically grinding a crystalline material to a desired particle size in a liquid that is not a solvent for the polymer, heating the crystalline particles dispersed in said liquid to above their melting temperature, and cooling the melted particles in said liquid to form amorphous particles. In preferred forms of the invention, the crystalline materials are photograghically useful materials, such as ultraviolet light absorbers and couplers.

MODES FOR CARRYING OUT THE INVENTION

Figure 1:
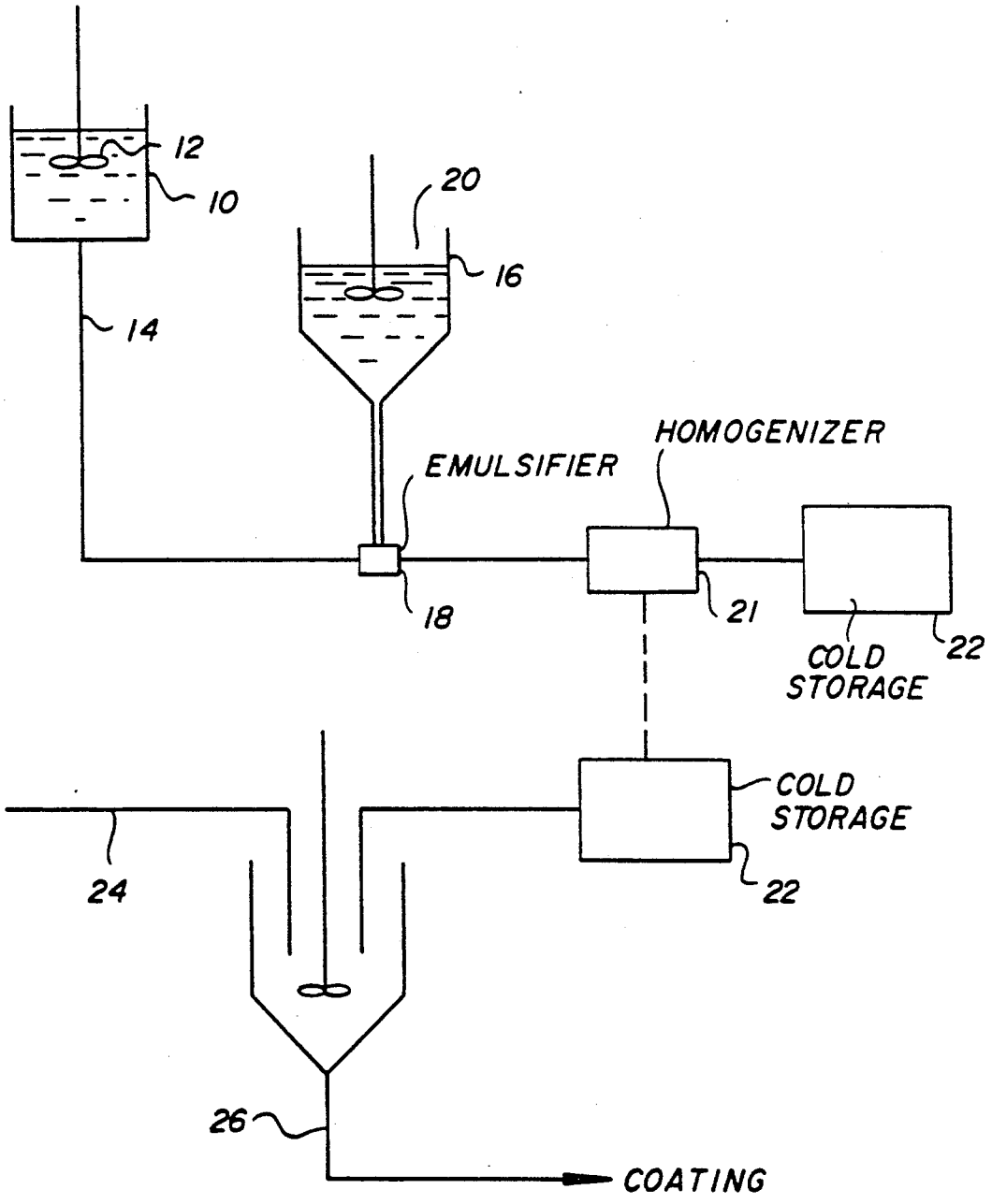
FIG. 1 PRIOR ART
FIG. 1 illustrates the prior method of forming particles of UV absorber or other materials for photographic products.

The invention has many advantages over prior processes for obtaining dispersions of amorphous crystalline materials. The method is low cost. The materials formed by the process are more storage stable. The particles formed are smaller than those formed in the emulsification processes previously used for forming UV (ultraviolet light) absorbers. Therefore, the UV control is more effective for a given amount of UV absorber. Therefore, photographic materials may use less silver and obtain whiter whites. Further, small particle size allows use of less gelatin in film layer formation. The finer UV absorbing compounds give better image in photographic products, as there is less light scattering and better UV absorption for a given amount of material in the product. UV absorbers prevent dye fade and yellowing of the base upon which the film is formed and, therefore, their more effective use is important. The particles of the invention process are generally spherical particles that provide more uniform properties. Another advantage is that the heating and cooling cycle to form the amorphous material of the invention may be delayed until immediately prior to use, thereby minimizing the opportunity for the UV absorbing material to crystallize during storage. The invention is more fully described in the drawings and the description below.

Illustrated in FIG. 1 is a prior process for formation of amorphous particles such as UV absorbers. In the system of FIG. 1, a crystalline material is placed into tank 10 that is stirred by mixer 12. Also into the tank 10 is placed a solvent for the crystalline material. The material is heated with agitation until the crystalline material is dissolved. A solvent polymer solution is withdrawn through conduit 14 and combined with material from the tank 16 at the emulsifier mixer 18. Tank 16, when utilized for photographic material, would ordinarily contain a gelatin and water solution 20 at 60° C. or below. The emulsifier 18 combines the solvent, material solution, and the cooler gel solution which then passes through homogenizer 21. After the homogenizer 21, the dispersion is placed into cold storage 22. Prior to coating, material is removed from cold storage 22 and combined with additional gel, water, and other photographic ingredients as needed from conduit 24 prior to exiting through conduit 26 to a coating process. When the process is utilized for UV stabilizers, the stabilizers are usually coated as a separate coat rather than being combined with silver halide and coupler layers.

Figure 2:
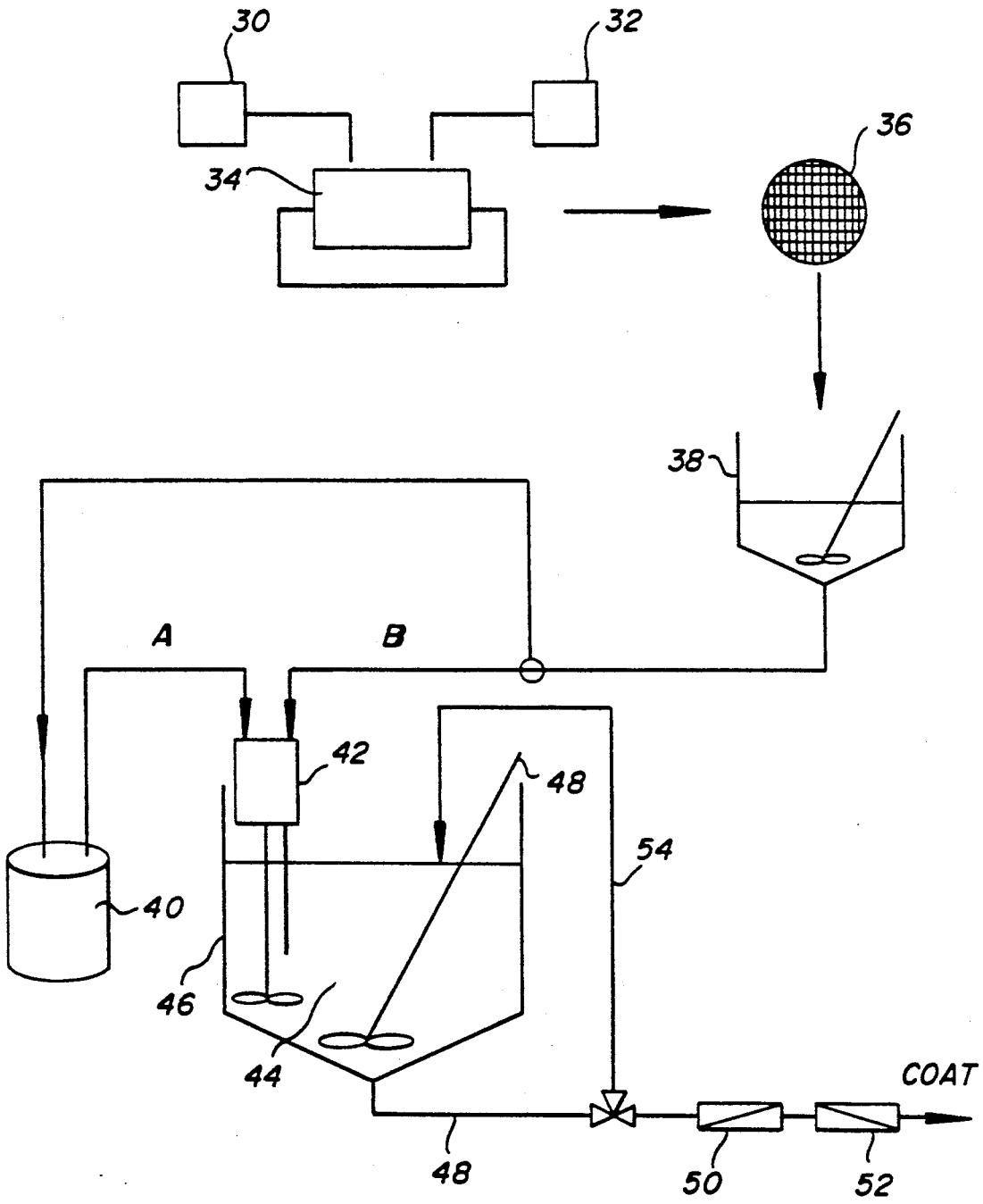
FIG. 2 illustrates schematically a process for carrying out the invention.

As illustrated in FIG. 2, crystalline material 30 and a nonsolvent liquid for the polymer 30 are added to a media mill 34. The media mill operates to reduce the material 30 to the desired size, after which it is passed through filter 36 and placed in mixing vat 38 where the amount of liquid to particle ratio may be adjusted. This material has not been heated and remains crystalline, and in the case of a UV absorbing material the nonsolvent for the material would be water. The milling and mixing would be carried out at about room temperature or 20° C. After leaving the mixing device 38, the slurry of particles may be either transferred to storage 40 or directly to subsurface addition device 42 for combination with a gelatin and water solution 44 in tank 46 that is agitated by mixer 48. After mixing of the crystalline UV absorber or other crystalline material with the gelatin water solution 44, it is passed from tank 46 through conduit 48 to inline heater 50. At inline heater 50, the crystalline material is heated to above its melting temperature. For the typical UV absorbing material, this would be above 75° C. After heating in heater 50, the material is immediately cooled in inline cooling section 52 to 40° C. and then immediately coated. Conduit 54 may be utilized to recirculate material during shutdowns of the process. The process and apparatus of FIG. 2 minimizes storage of amorphous material, as the solid amorphous material is not formed until a cooling device 52. There are typically no problems in storing of particulate crystalline material without agglomeration. Suitable surfactants may be utilized both in the milling and slurry-forming parts of the process, as well as in the gel-forming stage of container 46.

Figure 3:
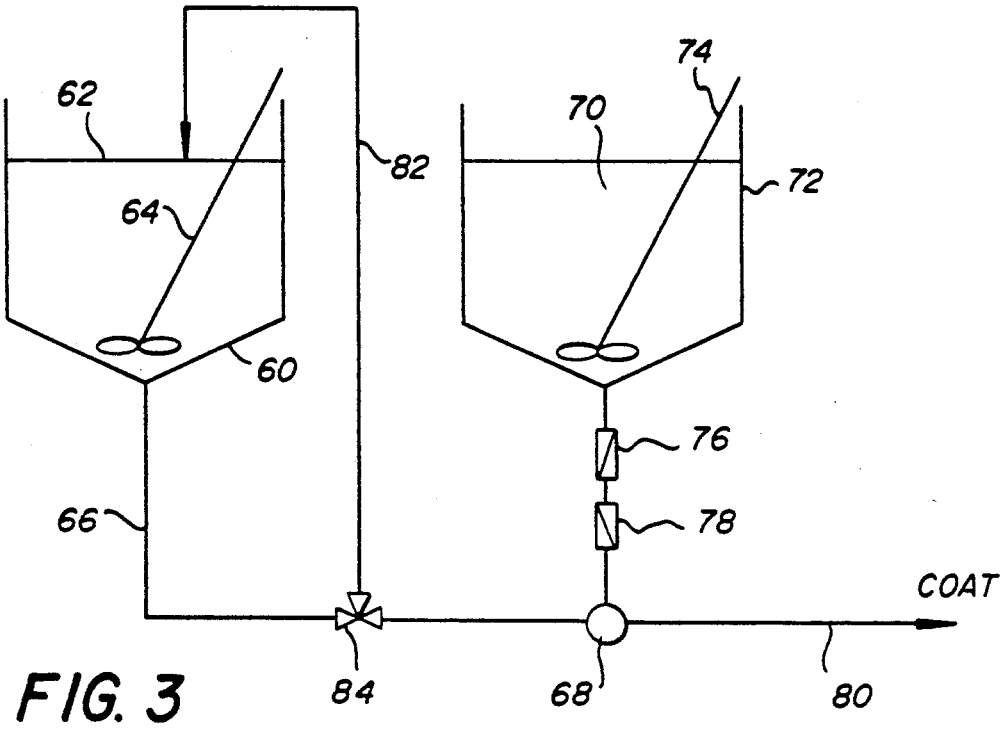
FIGS. 3 and 4 illustrate schematically alternative processes for carrying out the invention.
Figure 4:
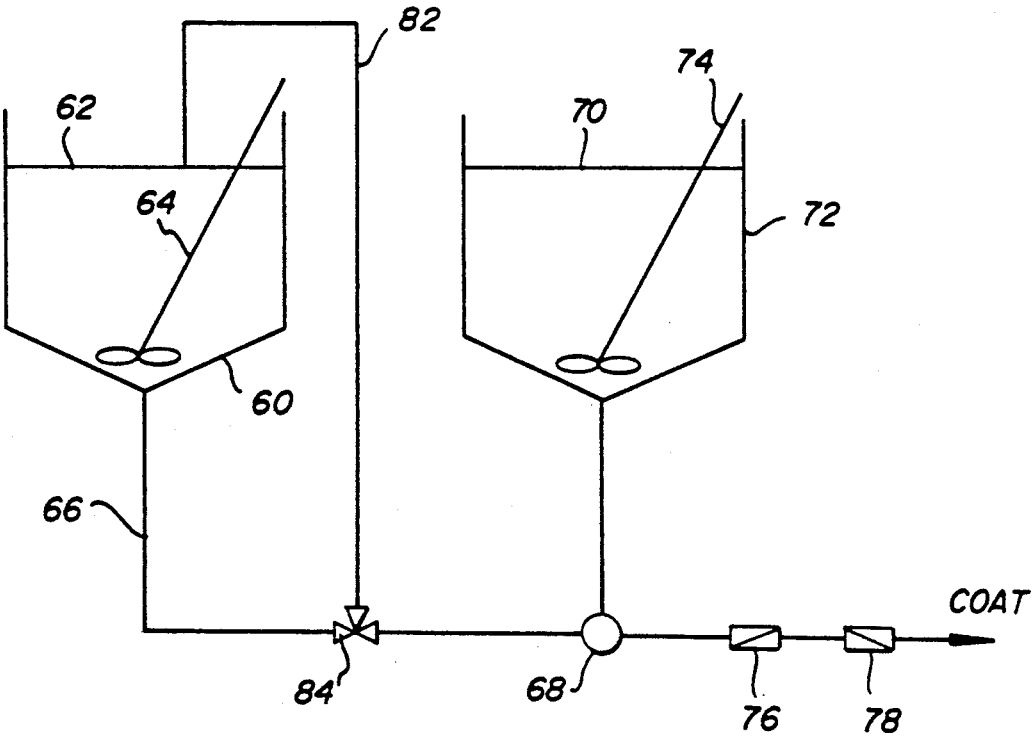

In an alternate embodiment of FIG. 3 for use with crystalline photographic materials such as UV stabilizers, there is a solution of gel and water 62 maintained in vat 60 with agitation by stirring device 64 at a temperature of about 40° C. The gelatin solution 62 is withdrawn through conduit 66 and into a rotor-stator mixer 68. A slurry of crystalline particles and water 70 are maintained in container 72 with agitation by stirrer 74. The slurry of crystalline particle 70 is formed by agitation of crystalline material in a media mill such as illustrated in FIG. 2. A slurry 70 is withdrawn through inline heater 76, followed by cooling in inline cooler 78 whereupon the amorphous cooled particles join the gelatin solution in rotor-stator mixer 68 immediately prior to coating after delivery by line 80. Conduit 82 is utilized for recirculation of the gelatin solution when the coating line is shut down and is controlled by valve 84. The process and apparatus of FIG. 4 is similar to FIG. 3 except the heating device 76 and cooling device 78 are subsequent to the rotor-stator mixer rather than prior to the combination with the gelatin solution.

The process of the invention may be applied to any crystalline materials for which spherical small particles are desired in a slurry or suspension that is to be solidified. Typical of such materials are the polymers, such as polypropylenes, polyethylene, and polyacrylamides, food materials such as sugars, and ceramic materials. Suitable for the process are photographically active groups, such as couplers, dyes, and inhibitors, oxidized developer scavengers DIR couplers, and masking couplers as these materials are desired in small particles for photographic uses. The process is preferred for UV absorbers. The process is particularly preferred for UV absorbers (2-(2'-hydroxy-3', 5'-di-tert-amylphenyl)benzotriazole) or 2-(3'-tert-butyl-2'-hydroxy-5'-methylphenyl)-5-chlorobenzotriazole, as fine particle size and stability in the amorphous phase are desired for these materials. Other suitable photographically active materials are di-octyhydroquinone, dodecylhydroquinone,

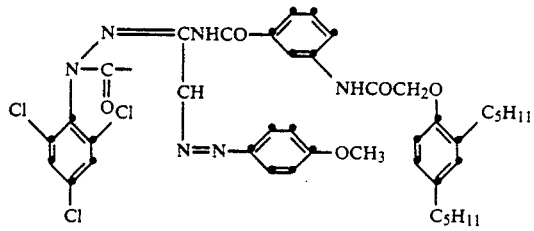

and

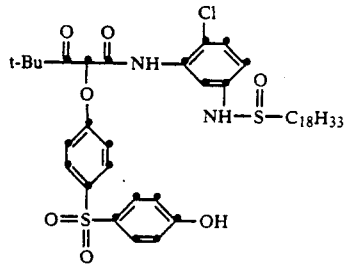

The material utilized during milling of the crystalline polymer may be any suitable liquid that is substantially a nonsolvent for the material that is to be reduced to small particle size. The preferred material for use with photographic materials is water or water and gelatin, as these materials are low in cost and compatible with a photographic process.

The liquid used during milling can be either aqueous or organic depending on the requirements of the dispersion and the physical and chemical characteristics of the dispersed phase. It is preferable that the crystalline melting temperature be lower than the boiling temperature of the liquid, although higher pressures allow dispersed crystalline polymer melting to occur at temperatures above the normal boiling temperature of the continuous phase. For aqueous systems, crystalline materials should exhibit melting below 100° C. for treatment at atmospheric pressure. Suitable materials for dispersal are inorganic and organic crystals, plastics, and resins which are amenable to fragmentation by mechanical milling. For photographic applications, materials such as benzotriazole UV absorbing compounds, dye-forming couplers, and polymeric particulates may be processed by fragmentation followed by thermal treatment to effect phase transition.

The fragmentation or grinding process may be accomplished by mechanical means using either a smearing or smashing action. Examples of smashing processes include hammer milling, jet milling, ball milling, or media milling. Ball milling or media milling uses grinding media which may be ceramic, steel, or glass ranging from 0.1 mm to 100 mm and may be spherical, cylindrical, or other geometry. Roller milling is an example of a smearing process which may be used. Particle sizes before milling may range from 0.1 μm to 10 mm, and final particle sizes may range from 0.01 μm to 1000 μm. The preferred size for UV absorbers is between about 0.01 μm and about 0.3 μm.

Stabilization of dispersed particles may be effected if desired by use of surfactants, dispersants, steric stabilizers, polymers, gelatin, and charge agents. For photographic applications, common suitable surfactants include Triton-X200 (sodium alkylarylpolyethersulfonate) or preferably Alkanol-XC TM (di propyl naphthalene sulfonate from DuPont).

The dispersion may be prepared from 1 to 70 percent dispersed polymer by weight and may include more than one material in the dispersed phase. Mixtures of various materials may be used, with one or more materials amenable to thermal treatment as described previously.

A preferred application of the thermal treatment process includes preparation of a UV absorbing dispersion of (2- (2'-hydroxy-3',5'- di-tertamylphenyl)benzotriazole which is crystalline and melts at about 80° C. An aqueous slurry at 1–70 weight percent (2-(2'-hydroxy-3',5'-di-tert-amylphenyl)benzotriazole and 1–20 weight percent, the surfactant alkanol-XC TM, may be prepared with initial crystal sizes ranging from 0.1 μm to 10 mm. Subsequent media milling of this dispersion reduces particles size to 0.01 μm to 0.03 μm. The spectral absorbance properties of this microcrystalline dispersion are significantly altered after thermal treatment which melts and then cools the dispersed crystals to spherical, amorphous particles. This shift in absorbance is advantageous since the coated dispersion exhibits minimal visible absorbance with substantially complete UV absorbance. This allows use of reduced silver in the yellow layer since negligible glue light is absorbed in the UV layer. Also, improved whiteness is possible by reducing yellowing normally attributed to conventional UV absorber dispersions. With reduced yellow absorption, optical brighteners may be reduced in level while maintaining equal whiteness.

Conventional methods of dispersing this material as set forth above include dissolving crystals with solvents followed by emulsification of the dissolved solution into gelatin. The obtained particle size by this method is usually not less than 0.5 μm. Solvents are used to reduce particle size, alter the particle refractive index to achieve transparency, and improve stability against recrystallization. The use of solvents is disadvantageous since additional gelatin is required as binder in coatings, solvents may leach out of particles and coatings, and solvents may present health and environmental hazards.

The process of thermal treatment of the microcrystalline particle dispersion may be used in place of conventional methods to achieve similar or superior dispersion performance by creating smaller particles without solvent. The particle sizes obtained by the invention process may be sufficiently small to minimize light scatter which can reduce transparency of the UV layer and image sharpness in photographic materials.

The stability of the microcrystalline dispersion is much superior to that of conventional dispersions. Conventional dispersions of UV compounds tend to recrystallize prior to coating, rendering them unfit for use. This recrystallization may occur in chill-set gelatin or gelatin solutions at elevated temperatures. The improved stability of the microcrystalline dispersion allows for greater shelf life prior to coating and greater flexibility in manufacturing processes. The microcrystalline dispersion is stable without addition of gelatin and may be refrigerated to extend stability against crystal growth for up to 6 months. The thermal treatment may be conducted immediately prior to coating on photographic film or paper, thereby minimizing the time the UV absorber particles exist in solution in the amorphous state. Prior processes did not allow this time to be minimized.

It is also possible by this invention to conduct thermal treatment after coating the microcrystalline dispersion. After water has been dried from the photographic coating, microcrystals suspended in the gelatin binder are amenable to thermal treatment as described previously. The resultant modification of spectral absorption is comparable to that of coatings made with heat-treated dispersions.

The following Examples are illustrative and not exhaustive of the performance of the invention. Parts and percentage are by weight unless otherwise noted. The compositions set forth in the examples may not include conventional ingredients not related to the invention such as fungicides, antifoamants, and hardeners.

EXAMPLE 1

An aqueous microcrystalline dispersion Of Tinuvin 328 (2-(2'-hydroxy-3',5'-di-tert-amylphenyl)benzotriazole) is prepared by slurrying the following ingredients:

| | |
|---|---|
| (2-(2'-hydroxy-3',5'-di-tert-amylphenyl)benzotriazole | 1–50% |
| Alkanol-XC TM | 1–10% |
| Water | 40–98% |

This slurry is milled using a horizontal media mill using 0.3 mm zirconium silicate grinding media. The final particle size averages 0.01–0.03 μm. The mean particle size is 0.08.

Figure 5:
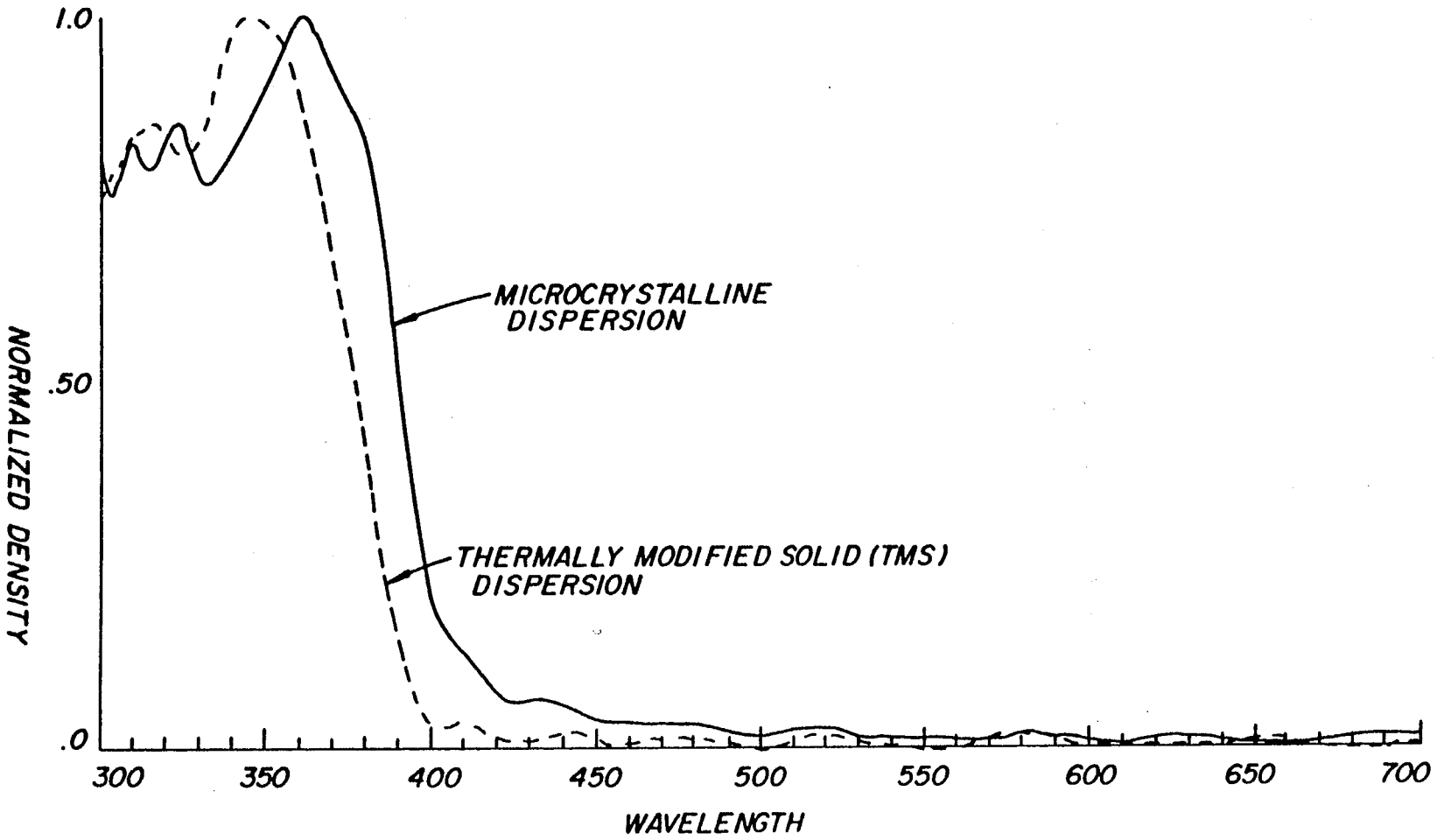
FIGS. 5 and 6 illustrate results obtained in the examples.
Figure 6:
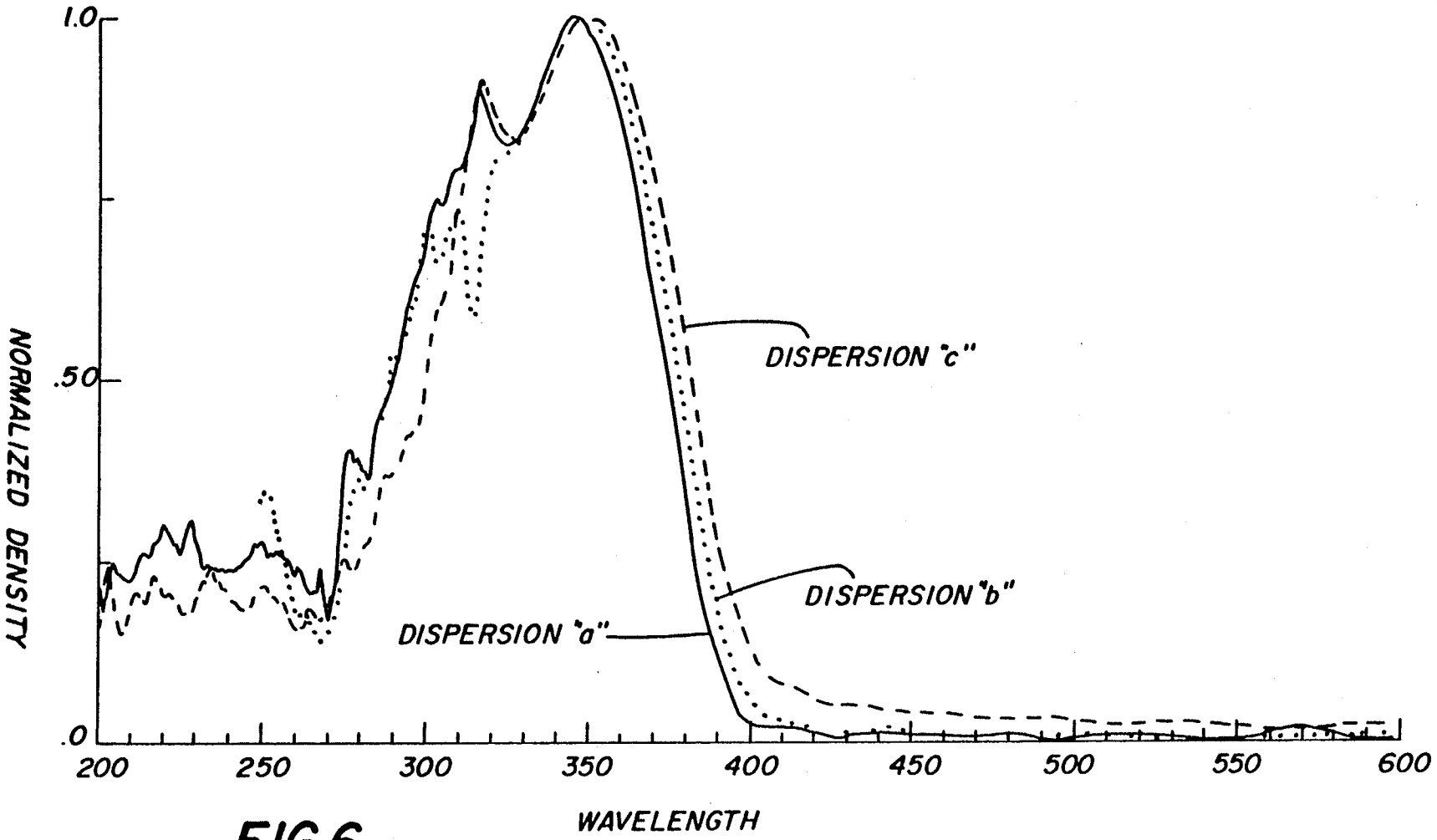

FIG. 5 shows the transmission spectral absorbance of this microcrystalline dispersion in a single layer on a clear polyester support before and after thermal treatment of heating to 81° C. The laydown was about 70 mg of UV absorber and 130 mg gelatin. As shown, a 10–15 nm hipsochromic shift in spectral absorbance is achieved by the invention, and most visible absorbance is eliminated. FIG. 6 shows the heat treated dispersion performance relative to conventional dispersions (see Table 2) using mixtures of UV absorbers and solvents. The dispersion "a" of the invention shows a shift to lower wavelength absorbance. This is preferred because it eliminates visible absorbance which is detrimental to photographic absorbance as stain is increased. The "b" and "c" dispersions have more stain as they absorb more visible light. The reduced visible absorbance of the heat-treated dispersion is advantageous in photographic coatings, as demonstrated in Example 2.

EXAMPLE 2

Three dispersions were coated to form a color paper in the following format:

TABLE 1

| Layer | Coating Amount (mg/ft$^2$ and Material |
|---|---|
| SOC | 125 mg/ft$^2$ gelatin (protective layer) |
| UV | 35 mg/ft$^2$ UV, 65 mg/ft$^2$ gel (Dispersion of a, b, or c) |
| Cyan | 18.4 mg Ag, 39.3 mg cyan coupler, 100 mg gel |
| UV | 35 mg UV, 65 mg gel (Dispersion of a, b, or c) |
| Magenta | 27.6 mg Ag, 39.3 mg magenta coupler, 115 mg gel |
| Inter-layer | 70 mg gel, 8.75 mg DOX scavenger |
| Yellow | 26 mg Ag, 100 mg yellow coupler, 140 mg gel |
| Paper support | |

TABLE 2

| UV Dispersion | Composition |
|---|---|
| a | invention (thermally modified Tinuvin 328) |
| b | Tinuvin 328*/Tinuvin 326**/ Solvent*** = 1:0.17:0.39 |
| c | Tinuvin 328/Tinuvin 326 = 1.0:17 |

*Tinuvin 328 comprises (2-(2'-hydroxy-3',5'-di-tert-amylphenyl)benzotriazole)
**Tinuvin 326 comprises 2-(3'-tert-butyl-2'-hydroxy-5'-methylphenyl)-5-chlorobenzotriazole
***Solvent comprises 1,4 cyclohexylenedemethylene bis(2-ethylhexanoate)

Each coating was processed using standard RA4 processing. Standard sensitometric evaluation indicated equivalent response for all three dispersions, as summarized in Table 3.

TABLE 3

| Dispersion | Ave of Photographic Parameters, & Replicates (Numbers are the average of 6 replicates) | | |
|---|---|---|---|
| | .40 Toe/1 Sigma* | .20 Toe/1 Sigma* | .4 Shoulder/ 1 Sigma** |
| | CYAN | | |
| b | .146 ± .001 | .350 ± .003 | 1.988 ± 0.18 |
| c | .152 ± .006 | .352 ± .012 | 2.007 ± 0.24 |
| a | .159 ± .003 | .362 ± .003 | 2.007 ± 0.13 |
| | .40 Toe/1 Sigma | .20 Toe/1 Sigma | .4 Shoulder/ 1 Sigma |
| | MAGENTA | | |
| b | .149 ± .004 | .355 ± .008 | 2.074 ± .014 |
| c | .150 ± .005 | .359 ± .001 | 2.047 ± .018 |
| a | .144 ± .005 | .352 ± .002 | 2.081 ± .013 |
| | YELLOW | | |
| b | .163 ± .003 | .384 ± .002 | 1.937 ± .012 |
| c | .160 ± .002 | .380 ± .005 | 1.923 ± .015 |
| a | .155 ± .002 | .378 ± .002 | 1.939 ± .007 |

*.40 or .20 log exposure units from a density of 1.0 at the toe of the sensitometric curve
**.4 log exposure units from a density of 1.0 at the shoulder of the sensitometric curve The three coatings were also developed by RA-4 processing when unexposed, an advantage of reduced blue dmin stain density is shown with dispersion-a of the invention in Table 4. A difference of 0.004 is considered significant as the human eye can tell the difference. A Spectroguard Densitometer was utilized for the test to measure the precise colorimetric densities.

TABLE 4

| Dispersion | Red Density | Green Density | Blue Density |
|---|---|---|---|
| a | 0.076 | 0.076 | 0.085 |
| b | 0.075 | 0.073 | 0.089 |
| c | 0.076 | 0.073 | 0.093 |

Variations in location of the UV absorbing layer are possible using the thermally modified dispersion, using all the UV in either the layer above or below the cyan layer.

EXAMPLE 3

In certain applications UV protection may not be required above the cyan layer, and all UV protection may be placed between the cyan and magenta layers. Example 2 shows that the invention UV dispersion may be coated at reduced gelatin laydown below the UV layer.

Variation A

SOC—100 mg gelatin (protective layer)

Cyan—18.4 mg Ag, 39.3 mg cyan coupler B, 100 mg gel

UV—60 mg UV, 60 mg gel (UV is experimental UV dispersion as in Dispersion a in Example 1)

Magenta—27.6 mg Ag, 39.3 mg magenta coupler C, 115 mg gel

Interlayer—70 mg gel, 8.75 mg DOX scavenger

Yellow—26 mg Ag, 100 mg yellow coupler A, 140 mg gel

Variation B

As a, but 40 mg gel in UV layer

Variation C

As a, but 30 mg gel in UV layer

Variation D (control)

As a, but UV dispersion is conventional dispersion b in Example 1 at 60 mg UV and 42 mg gel

Variation E (control)

As a, but 30 mg dispersion b and 58.5 mg gel above the cyan layer and 30 mg dispersion b and 58.5 mg gel below the cyan layer (standard split-UV format)

TABLE 5

| | a | b | c | d (coated) | e (control) |
|---|---|---|---|---|---|
| Blue Dmin** | 0.085 | 0.083 | 0.082 | 0.084 | 0.088 |
| Sharpness* | 91.9 | 92.3 | 92.6 | 92.5 | 92.0 |
| Separation Defect | — | — | — | + | — |
| Gel reduction | 55 | 75 | 85 | 73 | 0 |

*Technique of R. G. Gendson as in Journal Soc. Motion Picture and Television Engr.
**Measured with Spectrometer techniques that measure precise colorimetric densities using a Spectroguard TM densitometer As shown in Table 5, as gelatin is removed from experimental UV variations a, b, and c, there is a corresponding decrease in Blue Dmin Stain and increase in Sharpness relative to the standard check in variation e. Variation d includes conventional dispersion b of Example 1 at 42 mg gel (the lowest possible gel laydown for a conventional dispersion which requires at least this much gelatin in the dispersion preparation process) and shows a similar reduction in stain and sharpness improvement. However, variation d when subjected to a high temperature lamination simulation test shows a layer separation defect. All other variations showed no defect, and variation d showed this defect, indicating that conventional dispersions including solvents may not be coated at reduced gelatin levels where paper may be subjected to lamination processes.

All other standard photographic tests showed equivalent response for variations a-e.

Due to the high materials cost of gelatin, this level of gel reduction represents a significant reduction in the cost of manufacturing paper. Also, the invention UV dispersion facilitates upper UV layer elimination which allows greater flexibility in manufacturing coating processes. Layer elimination and gel reduction serve to reduce unwanted light scatter and improve overall photographic performance.

Similar coatings were made with all the UV dispersions coated above the cyan layer, and the results were consistent with those found in Example 2.

Coupler A

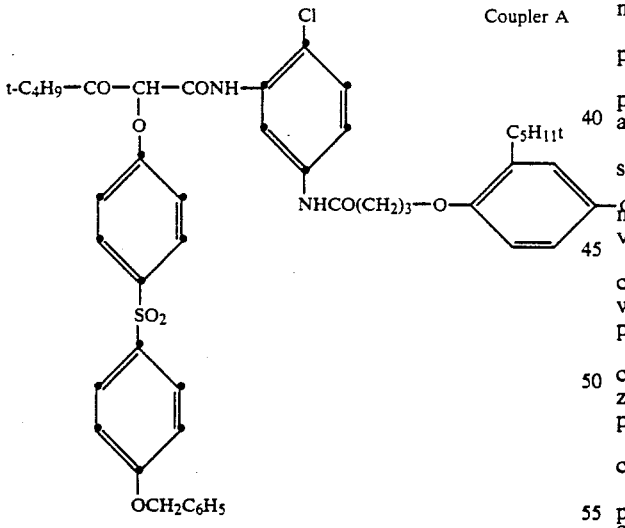

Coupler B

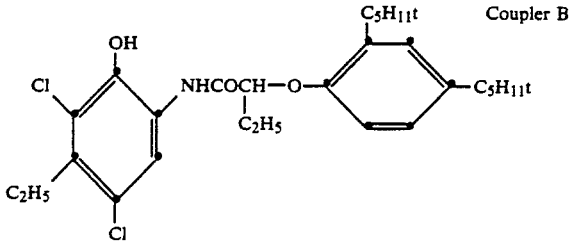

-continued

Coupler C

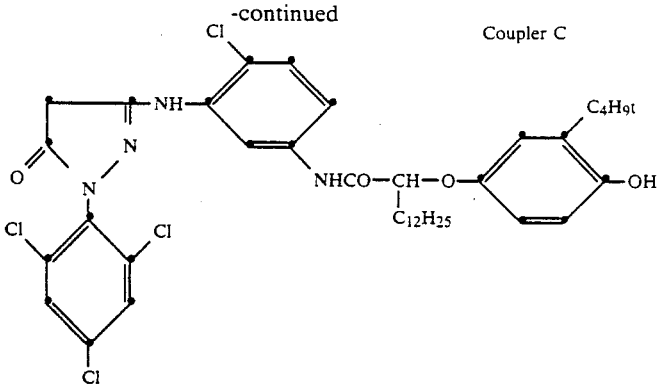

The invention has been described in detail with particular reference to preferred embodiments thereof, but it will be understood that variations and modifications can be effected within the spirit and scope of the invention.

We claim:

1. A process of forming amorphous particle dispersions comprising
   mechanically grinding a crystalline material to a desired size particle in a liquid that is not a solvent for said material;
   heating said crystalline particles dispersed in said liquid, to above their melting temperature; and
   cooling the melted particles in said liquid to form amorphous particles.

2. The process of claim 1 wherein said amorphous particles are added to a gelatin solution and coated on a substrate.

3. The process of claim 1 wherein said liquid comprises water.

4. The process of claim 3 wherein said cooling is by combination with a gelatin water solution at below the melting temperature of said particles.

5. The process of claim 1 wherein said material comprises a UV absorber.

6. The process of claim 1 wherein said material comprises at least one of a dye, dox scavenger, a coupler, or a UV absorber.

7. The process of claim 2 wherein the layer coated on said substrate comprises a photographic element.

8. The process of claim 1 wherein said crystalline material in said liquid is heated under pressure to prevent the dispersing liquid from vaporizing.

9. The process of claim 1 wherein said melted particles are in water and are combined with a heated gelatin water solution prior to cooling to form said amorphous particles.

10. The process of claim 1 wherein said material comprises (2-(2'-hydroxy-3',5'-di-tert-amylphenyl)benzotriazole or 2-(3'-tert-butyl-2'-hydroxy-5'-methylphenyl)-5-chlorobenzotriazole.

11. The process of claim 1 wherein said grinding is carried out in a media mill.

12. The method of claim 1 wherein said amorphous particles have a particle size of between about 0.01 and 0.3 micron.

13. A photographic element wherein at least one layer of said element comprises amorphous ultraviolet absorber in a particle size of between about 0.01 and about 0.3 micron.

14. The element of claim 13 wherein said ultraviolet absorber is between the upper surface and upper silver halide containing yellow layer of said element.

15. The element of claim 14 wherein said ultraviolet layer comprises (2-(2'-hydroxy-3'-5'-di-tert-amylphenyl)benzotriazole or 2-(3'-tert-butyl-2'-hydroxy-5'-methylphenyl)-5-chlorobenzotriazole.

16. The element of claim 13 wherein said amorphous particles are spherical.

* * * * *